US010036249B2

(12) United States Patent
Gudat

(10) Patent No.: US 10,036,249 B2
(45) Date of Patent: Jul. 31, 2018

(54) MACHINE HAVING BOUNDARY TRACKING SYSTEM

(75) Inventor: Adam John Gudat, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 2562 days.

(21) Appl. No.: 11/139,788

(22) Filed: May 31, 2005

(65) Prior Publication Data

US 2006/0265914 A1 Nov. 30, 2006

(51) Int. Cl.

| | |
|---|---|
| ***E02F 5/02*** | (2006.01) |
| ***E21C 35/08*** | (2006.01) |
| ***E02F 9/24*** | (2006.01) |
| ***E02F 9/26*** | (2006.01) |

(52) U.S. Cl.

CPC ..... *E21C 35/08* (2013.01); *E02F 9/245* (2013.01); *E02F 9/26* (2013.01)

(58) Field of Classification Search

CPC ..... E21C 35/08; E02F 9/245; E02F 9/26
USPC ..... 37/348, 382, 414, 413, 906; 172/2, 4; 414/699; 299/1.1; 701/50, 223, 300; 342/459, 463

See application file for complete search history.

(56) References Cited

U.S. PATENT DOCUMENTS

| | | | | |
|---|---|---|---|---|
| 2,513,320 | A * | 7/1950 | Hawkins | 342/395 |
| 3,876,980 | A * | 4/1975 | Haemmig et al. | 714/822 |
| 5,168,473 | A * | 12/1992 | Parra | 367/124 |
| 5,193,883 | A | 3/1993 | Spies | |
| 5,375,059 | A | 12/1994 | Kyrtsos et al. | |
| 5,535,532 | A | 7/1996 | Fujii et al. | |
| 5,647,439 | A | 7/1997 | Burdick et al. | |
| 5,864,060 | A | 1/1999 | Henderson et al. | |
| 5,920,194 | A | 7/1999 | Lewis et al. | |
| 5,969,661 | A | 10/1999 | Benjamin | |
| 6,044,316 | A * | 3/2000 | Mullins | 701/50 |
| 6,082,466 | A | 7/2000 | Gudat | |
| 6,119,376 | A | 9/2000 | Stump | |
| 6,128,574 | A * | 10/2000 | Diekhans | 701/209 |
| 6,282,477 | B1 | 8/2001 | Gudat et al. | |
| 6,380,906 | B1 | 4/2002 | Cesulka | |

(Continued)

FOREIGN PATENT DOCUMENTS

| | | |
|---|---|---|
| WO | WO 00/22455 | 4/2000 |
| WO | WO 01/52352 A1 | 7/2001 |

OTHER PUBLICATIONS

"Virtual Wire® Second-Generation ASH Short-Range Radio Products, Short Form Catalog," RFM Monolithics, Inc., dated Jan. 2001, 18 pages.

(Continued)

*Primary Examiner* — Thomas B Will
*Assistant Examiner* — Mai T Nguyen
(74) *Attorney, Agent, or Firm* — Finnegan, Henderson, Farabow, Garrett & Dunner, LLP

(57) ABSTRACT

The boundary tracking system has a plurality of signal transmitting devices located to represent at least one boundary of a work site. The boundary tracking system also has a receiving device configured to receive signals transmitted from one or more of the plurality of transmitting devices and to generate an output based on the received signals. The boundary tracking system also has a controller configured to determine a location of at least one of the plurality of transmitting devices based on the output from the receiving device.

27 Claims, 4 Drawing Sheets

(56) References Cited

U.S. PATENT DOCUMENTS

| | | | | |
|---|---|---|---|---|
| 6,414,633 | B1 * | 7/2002 | Delalat | 342/442 |
| 6,437,726 | B1 * | 8/2002 | Price | 342/22 |
| 6,453,790 | B1 | 9/2002 | Cesulka et al. | |
| 6,456,240 | B1 * | 9/2002 | Cesulka | 342/463 |
| 6,541,966 | B1 | 4/2003 | Keene | |
| 6,597,992 | B2 * | 7/2003 | Rooney et al. | 702/5 |
| 6,603,422 | B2 | 8/2003 | Wright | |
| 6,771,609 | B1 | 8/2004 | Gudat et al. | |
| 7,205,939 | B2 * | 4/2007 | Zimmerman | 342/464 |
| 2004/0171388 | A1 * | 9/2004 | Couronne et al. | 455/456.1 |
| 2004/0210370 | A1 | 10/2004 | Gudat et al. | |
| 2005/0012499 | A1 | 1/2005 | La Rosa et al. | |
| 2005/0012635 | A1 * | 1/2005 | Seifert | 340/815.4 |

OTHER PUBLICATIONS

Miller et al., "Effects of soil physical properties on GPR for landmine detection," Fifth International Symposium on Technology and the Mine Problem, 2002, 10 pages.

* cited by examiner

MACHINE HAVING BOUNDARY TRACKING SYSTEM

TECHNICAL FIELD

The present disclosure is directed to a work machine, and more particularly, to a work machine having a boundary tracking system.

BACKGROUND

Mining operations typically involve blasting and other techniques designed to fragment a rock-mass. Blasting may be necessary to fragment the rock-mass and loosen a resulting muck pile for efficient excavation. Prior to blasting, a geological survey of the rock-mass may be conducted to determine boundaries between high-grade ore, low-grade ore, and waste. However, blasting may cause non-uniform movement of the rock-mass and, consequently, the boundaries between the high-grade ore, low-grade-ore and waste may shift. These shifted boundaries may reduce the accurate delineation between ore and waste regions within the resulting muck pile. As a consequence, ore may cross a previously determined boundary and move into a region designated as waste, where it may be subsequently discarded. Also, dilution of the mined ore can occur when waste material moves across a boundary into an ore region. The ore diluted with waste material may be sent to a concentrator for further processing, which may reduce the efficiency of the ore extraction process. If the movement of the rock-mass following a blast can be accurately tracked, ore loss or dilution may be reduced, increasing mining efficiency and profitability.

Devices and methods have been developed to monitor rock movement caused by blasting. One such device is described in U.S. Patent Publication No. 2005/0012499 ("the '499 publication"), to La Rosa et al, published Jan. 20, 2005. The '499 publication describes a blast movement monitor (BMM) that is placed within a rock-mass. The BMM includes a transmitter for transmitting a signal from the BMM to a detector. Multiple BMMs are placed within the rock-mass and the positions of each BMM are determined before and after the blast. To detect the BMMs, an operator moves across the surface of the blasted rock-mass with a handheld detector. The movement of the rock-mass and boundaries between the ore and waste regions can be approximated by determining the positions of the BMMs before and after the blast.

Although the use of BMMs described in the '499 publication may reduce ore loss or dilution resulting from rock movement following a blast, manual detection of the BMMs may be labor intensive and inefficient as the operator manually moves across the rock-mass, detects the BMMs, and plots BMM movement prior to the excavation process. Further inefficiencies may be created as the work machine operator reads and interprets the plots during the excavation process. Human error may be further increased as the operator may not be provided with an indication of the relative position of the work machine or work tool in relation to the BMMs or plot data.

The boundary tracking system of the present disclosure solves one or more of the problems set forth above.

SUMMARY OF THE INVENTION

One aspect of the present disclosure is directed to a boundary tracking system. The boundary tracking system includes a plurality of signal transmitting devices located to represent at least one boundary of a work site. The boundary tracking system also includes a receiving device configured to receive signals transmitted from one or more of the plurality of transmitting devices and to generate an output based on the received signals. The boundary tracking system also includes a controller configured to determine a location of at least one of the plurality of transmitting devices based on the output from the receiving device.

Another aspect of the present disclosure is directed to a method of tracking a boundary. The method includes receiving one or more signals from at least one of a plurality of transmitting devices located to represent at least one boundary. The method also includes determining a location of the at least one of the plurality of transmitting devices based on the one or more signals. The method also includes controlling at least one function of a work machine based on the location of the at least one of the plurality of transmitting devices.

DETAILED DESCRIPTION

Figure 1:
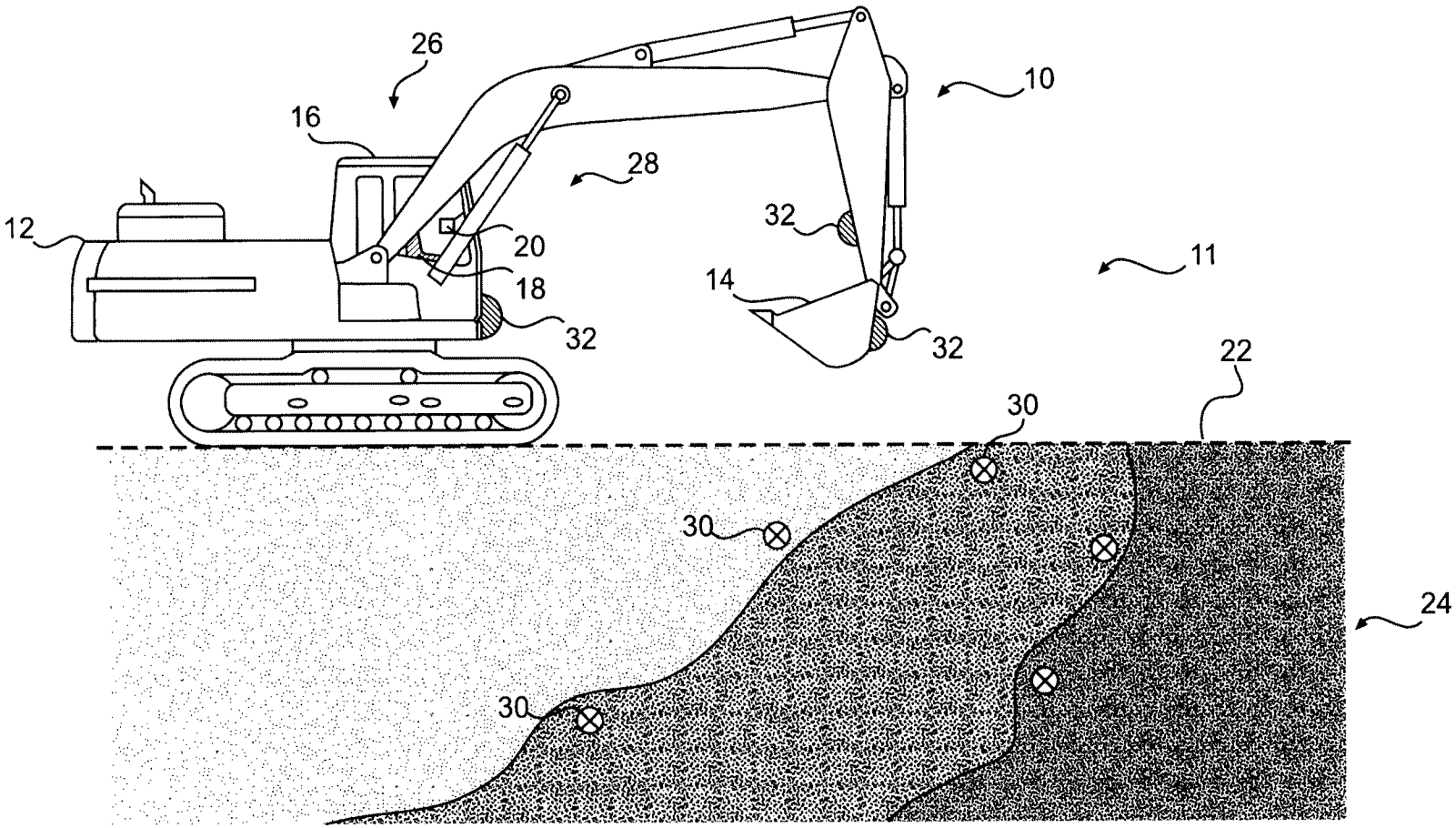
FIG. 1 is a diagrammatic illustration of the work machine showing the boundary tracking system.

FIG. 1 illustrates an exemplary work machine 10 that may include components operational as part of a boundary tracking system 11. Work machine 10 may be a fixed or mobile machine that performs some type of operation associated with an industry such as mining, construction, farming, transportation, or any other industry known in the art. For example, work machine 10 may be an earth-moving machine such as an excavator, a shovel, a dozer, a loader, a backhoe, a motor grader, or any other earth moving machine. Work machine 10 may include a frame 12, at least one work tool 14, and an operator station 16.

Frame 12 may include any structural unit that supports movement of work machine 10 and/or work tool 14. Frame 12 may be, for example, a stationary base frame connecting a power source to a traction device, a movable frame member of a linkage system, or any other frame known in the art.

Work tool 14 may include any device used in the performance of a task. For example, work tool 14 may include a bucket, a blade, a shovel, a ripper, or any other suitable task-performing device. Work tool 14 may be configured to pivot, rotate, slide, swing, or move relative to frame 12 in any other manner known in the art.

Operator station 16 may include one or more devices for controlling the operation of work machine 10 and/or work tool 14. Operator station 16 may include a seat 18 and a display unit 20. Display unit 20 may be connected to operator station 16, seat 18, or to any other appropriate structure.

Boundary tracking system 11 may include components to track and display the location of boundaries. For example, boundary tracking system 11 may be used to track the movement of ore bodies or to define an operating boundary for work machine 10, such as, for example a path to lay underground piping. The boundaries may be used for earth moving processes where delineations of earth regions beneath a surface terrain 22 may be important. Boundary tracking system 11 may include a transmitting system 24, a receiving system 26 and display system 28.

Transmitting system 24 may be configured to indicate at least one boundary. For example transmitting system 24 may include a plurality of transmitting devices 30 that may be used to define an ore region, foundation outline, trench trajectory, or underground location. Transmitting devices 30 may be disposable, and may or may not be retrieved after the earth moving process is complete. Transmitting devices 30 may be designed to withstand a blast or forces that may be associated with an earth moving process.

Transmitting device 30 may be configured to transmit signals. Specifically, transmitting device 30 may operate in a frequency range from approximately 900 MHz to approximately 2.4 GHz, and may also include a receiving function. Transmitting device 30 may be configured to operate in any suitable frequency range and/or transmit a unique identification signal. The receiving function may allow transmitting device 30 to be queried from a remote location. For example transmitting devices 30 may be queried to initiate activation, wherein the activation of transmitting device 30 from an inactive state to an active state may conserve battery power during times when transmission is unnecessary. Transmitting devices 30 may also be remotely de-activated to minimize the potential interference of transmitting device 30 used in a past earth moving process with a current earth moving process or for any other similar reason. The query signal may provide data, energy, or communicate to transmitting device 30 any form of signal known in the art.

It is contemplated that a group of transmitting devices 30 may transmit a signal different from another group of transmitting devices 30 to differentiate between groups of transmitting devices 30. For example, the transmitting devices 30 may include first and second groups, each of transmitting devices 30 of the first group being configured to transmit a first signal, and each of transmitting devices 30 of the second group being configured to transmit a second signal. A group of transmitting devices 30 may include one or more transmitting devices 30. Transmitting devices 30 may be configured to transmit more than one frequency for long-range and/or short-range communication.

Receiving system 26 may include a receiving device 32 configured to receive signals transmitted from one or more of the plurality of transmitting devices 30, and to generate an output based on the received signals. Receiving device 32 may be located on work machine 10 or work tool 14. It is also contemplated that receiving device 32 may include an antenna. In particular the antenna may include a phased array antenna that may include a plurality of antenna elements. The antenna may, alternatively, include a horn antenna or any other suitable planar antenna.

Figure 2:
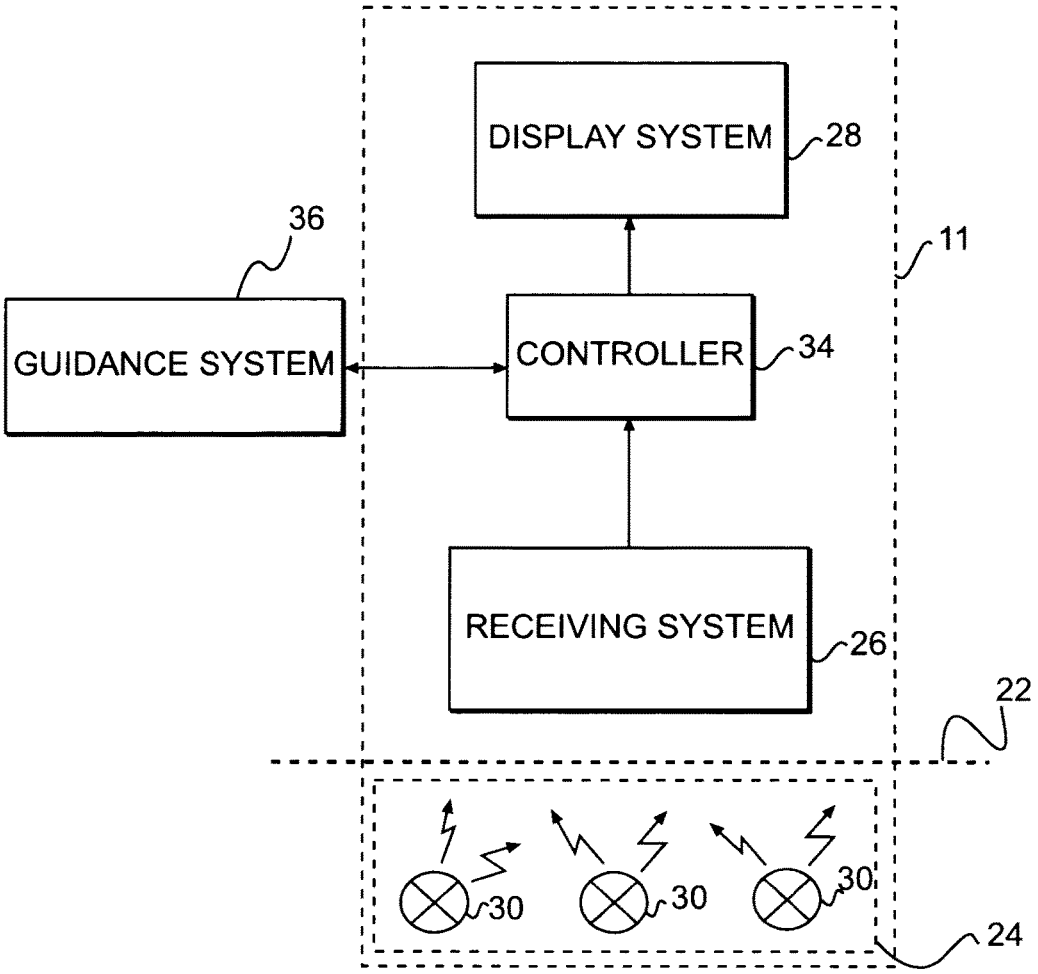
FIG. 2 is a schematic illustration of the boundary tracking system.

FIG. 2 illustrates a controller 34 that may be configured to determine a location of at least one of the plurality of transmitting devices 30 based on the output from receiving system 26. By selectively controlling which antenna elements of the phased array antenna are active, and monitoring the transmitted signals received by the antenna elements, controller 34 may determine the location of at least one of the plurality of transmitting devices 30. The location indicated by transmitting device 30 may or may not be the actual location of transmitting device 30. In particular, the determined location of transmitting device 30 may be representative of, predictive of or approximate within a specified range of a boundary location.

Controller 34 may be configured to determine the location of at least one boundary based on the location of at least one of the plurality of transmitting devices 30. Specifically, controller 34 may be configured to store the location information of at least one of the plurality of transmitting devices 30. Controller 34 may be configured to determine the location of at least one boundary based upon curve-fitting, interpolation, or any method for determining a line based on a plurality of data points known in the art. For example, the plurality of transmitting devices may include first and second groups, each of the transmitting devices of the first group being configured to transmit a first signal, and each of the transmitting devices of the second group being configured to transmit a second signal. Controller 34 may be configured to determine a first boundary location based on the locations of the first group of transmitting devices 30, and a second boundary location based on the locations of the second group of transmitting devices 30. It is also contemplated that boundary tracking system 11 may be associated with a guidance system 36 for work machine 10 or work tool 14.

Controller 34 may be configured to display on display system 28, the location of at least one of the plurality of transmitting devices 30. It is contemplated that controller 34 may be configured to display the locations of transmitting devices 30 in relation to work machine 10 or work tool 14. In particular, controller 34 may be configured to display the location of at least one boundary based on the location of at least one of the plurality of transmitting devices 30. It is also contemplated that controller 34 may be configured to display the locations of first and second boundaries based on the locations of a first group of transmitting devices 30 and the locations of a second group of transmitting devices 30, wherein the plurality of transmitting devices includes first and second groups, each of the transmitting devices of the first group being configured to transmit a first signal, and each of the transmitting devices of the second group being configured to transmit a second signal.

Controller 34 may be embodied in a single microprocessor or multiple microprocessors that include a means for monitoring or controlling the operation of boundary tracking system 11. Numerous commercially available microprocessors can be configured to perform the functions of controller. It should be appreciated that controller 34 could readily be embodied in a general work machine microprocessor capable of controlling numerous work machine functions. Controller 34 may include a memory, a secondary storage device, a processor, and any other components for running an application. Various other circuits may be associated with controller 34, such as power supply circuitry, signal conditioning circuitry, solenoid driver circuitry, and other types of suitable circuitry.

Display system 28 may include display unit 20 configured to display the locations of transmitting devices 30 based upon output from controller 34. Display system 28 may include indicator lights, a cathode-ray tube display, flat-panel display, liquid-crystal display and any other visual, audio or other signal to alert the operator. Display system 28 may display transmitting devices 30 in relation to work machine 10 or work tool 14, for positioning of work machine 10 or work tool 14 during operation. Specifically, display system 28 may be configured to display one or more boundaries represented by the locations of transmitting devices 30. Display system 28 may be configured to display more than one view of the excavation site, including desired and/or undesired excavation regions separated by boundaries.

Figure 3:
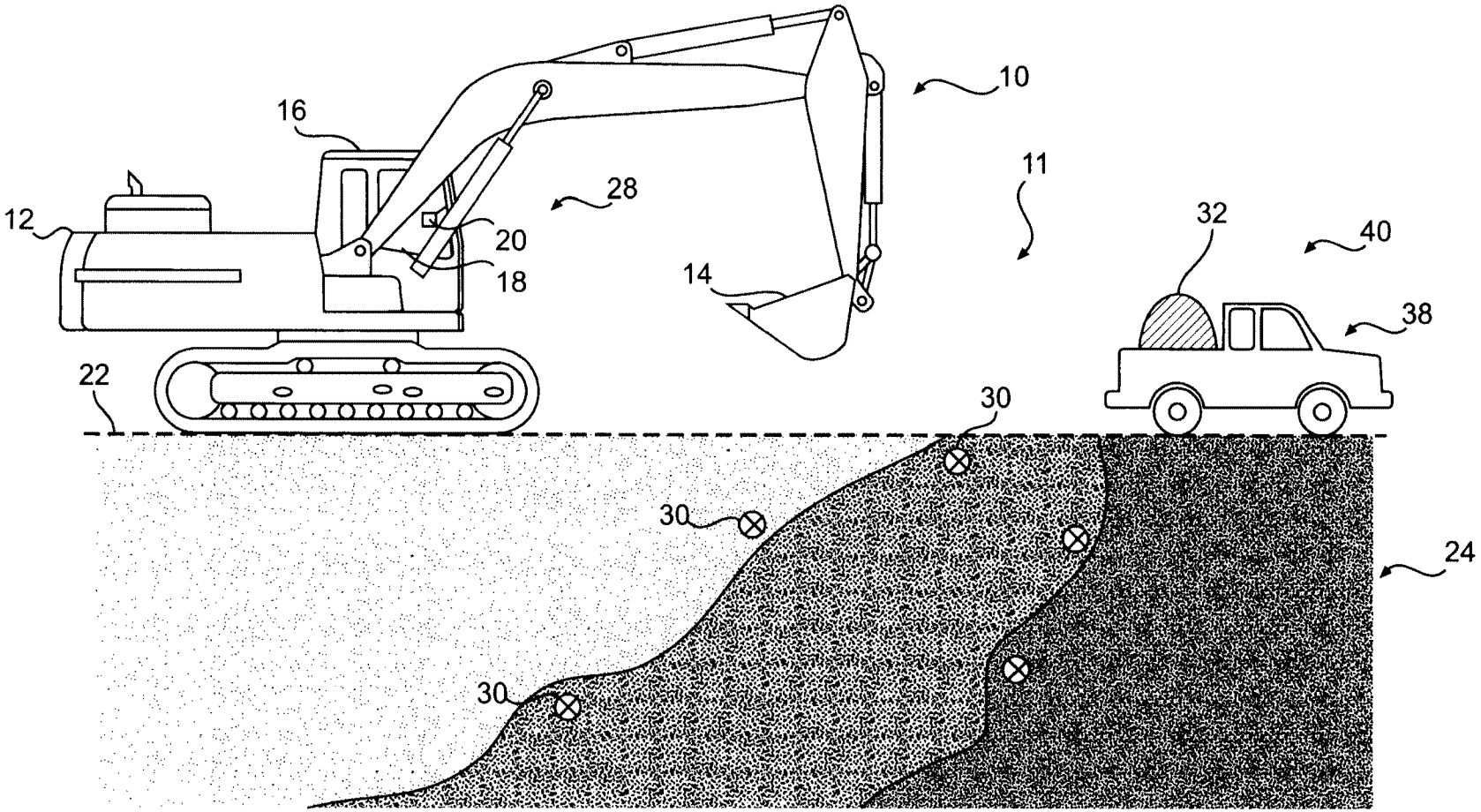
FIG. 3 is a diagrammatic illustration of the work machine showing an alternative embodiment of the boundary tracking system.

FIG. 3 illustrates an alternative embodiment of boundary tracking system 11 that may include a mobile receiving system 38. Mobile receiving system 38 may include receiving device 32 located remotely from work machine 10 and be configured to generate an output based on the received signals. For example, receiving device 32 may be mobile and/or mounted on an alternate work machine 40. In such embodiments, receiving device 32 may be configured to send an output to display unit 20 mounted on work machine 10.

Figure 4:
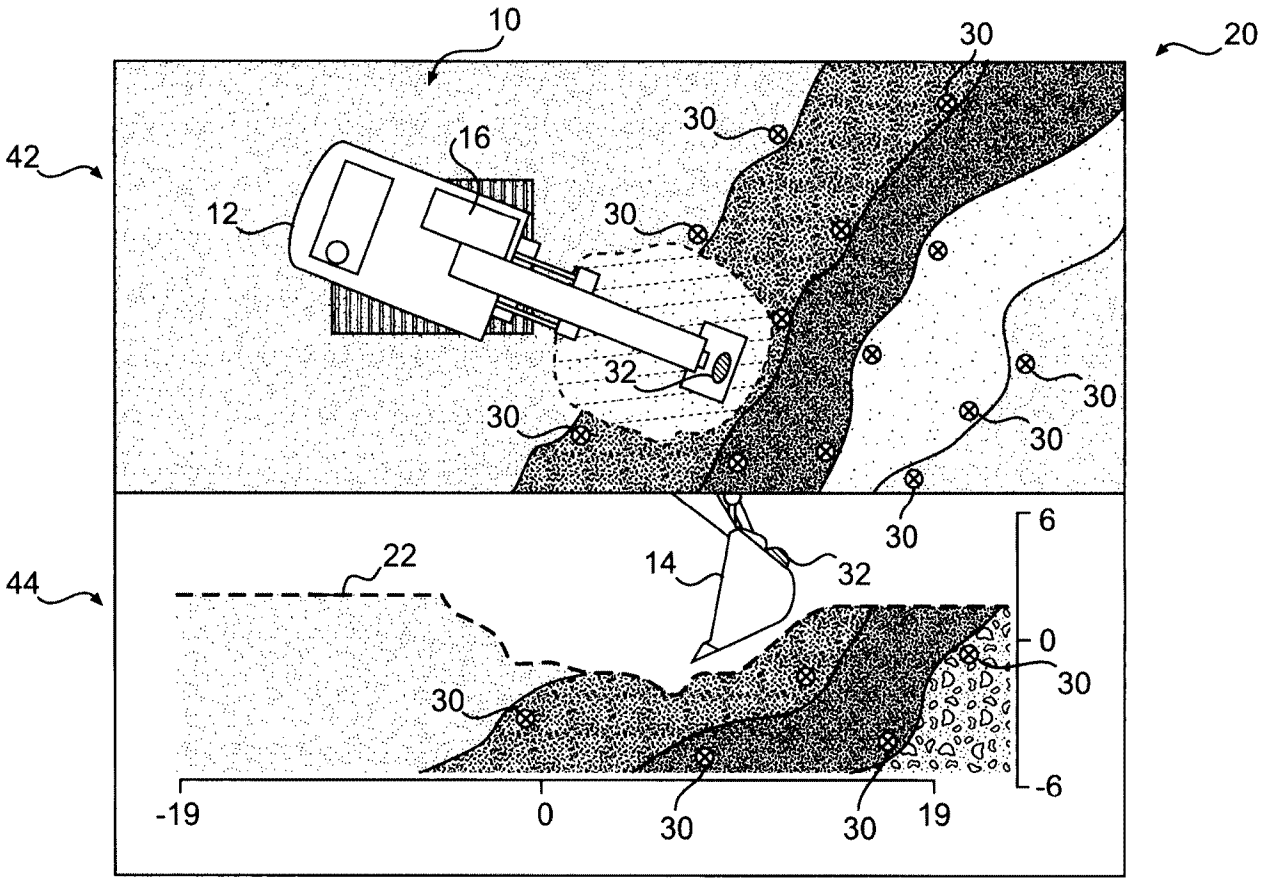
FIG. 4 is a diagrammatic illustration of the display unit showing the boundary tracking system.

FIG. 4 illustrates an exemplary display unit 20 displaying a two-dimensional top view 42 and a two-dimensional side profile view 44 of a rock-mass containing transmitting devices 30. Various regions of the rock-mass may be color-coded, cross-hatched, or gray-scaled to indicate the location of work tool 14 relative to the desired excavation region. The desired excavation region may be a first color, a less desirable excavation region may be a second color, and an undesired excavation region may be a third color. It is also contemplated that any number of boundaries may be displayed by display unit 20.

Display unit 20 may be updated on a continuous or periodic basis to allow the operator to track the progress of excavation. For example, display unit 20 may be updated on a continuous basis when work machine 10 is mining an ore body containing a large number of transmitting devices 30, mining ore of high value, excavating along a boundary, or performing an earth moving operation where specific regions of earth are defined. Alternatively, when work machine 10 is mining a large ore body, or performing an earth moving operation requiring broadly defined regions, display unit 20 may be updated on a periodic basis. The periodic update may occur when transmitting device 30 is detected, a boundary is crossed, or a different region is encountered.

INDUSTRIAL APPLICABILITY

The disclosed boundary tracking system 11 may be applicable to any situation where it may be desired to designate one or more earth-based boundaries. For example boundary tracking system 11 may be used to determine regions for excavation such as for ore mining, foundation digging, trench digging, or during any other appropriate excavation process. The operation of boundary tracking system 11 will now be described.

Initially, transmitting devices 30 may be distributed through the earth in preparation for operation of work machine 10. For example, during an ore mining operation, transmitting devices 30 may be placed along an ore body boundary. A blast may be required to loosen the ore body to facilitate ore removal. The blast may cause the ore boundary to move, and movement of the ore body may move transmitting devices 30. Transmitting devices 30 may be used to determine the final location of the ore body boundary, or track directions or magnitudes of earth movement resulting from blasting.

Boundary tracking system 11 may query transmitting devices 30 to activate transmitting devices 30 at any time before, during or after the blast, and thereby initiate the transmission signals. The transmission signals may be detected by receiving system 26, and converted by controller 34 to an output representative of the locations of transmitting devices 30. Display unit 20 may display representative locations of transmitting devices 30. For example, display unit 20 may display regions of desired and undesired excavation regions, with or without boundary lines. Display unit 20 may also display the position of work machine 10 and/or work tool 14 relative to the excavation regions.

Boundary tracking system 11 may, alternatively, include mobile receiving system 38 configured to transmit information to work machine 10. Mobile receiving system 38 may be handheld or, alternatively, may be mounted on alternate work machine 40, such as a small truck or other similar work machine. Mobile receiving system 38 may be operated independent of work machine 10. For example an operator may move mobile receiving system 38 over the earth or rock-mass to detect the signals from transmitting devices 30. Mobile receiving system 38 may output the location information from transmitting devices 30 to display unit 20 of work machine 10.

Alternate work machine 40 may be able to receive the signals from the transmitting devices 30 more efficiently than work machine 10. For example, alternate work machine 40 may be configured to move faster, operate less expensively, or require less maintenance than work machine 10. Following detection of transmitting devices 30 by alternate work machine 40, the location information may be transmitted to work machine 10 for display.

Mining operation efficiency may be improved as boundary tracking system 11 may automatically display the location of transmitting devices 30, regions of earth for excavation, and/or other boundaries. The time required to survey and mine an ore body may be reduced because boundary tracking system 11 may require fewer manual steps to convert the transmitted signals from transmitting devices 30 into a display. In addition, displaying work machine 10, work tool 14 or excavation areas on display unit 20 may improve operator interpretation of the boundary and ore body locations and accurate positioning of work tool 14. Improved operator interpretation and accurate positioning of the work tool may allow the operator to avoid low-grade ore regions and focus on the excavation of high-grade ore regions. For example, the operator may "blend" ore regions of different grades to allow processing of consistent ore concentrations.

It will be apparent to those skilled in the art that various modifications and variations can be made to the boundary tracking system of the present disclosure without departing from the scope of the disclosure. Other embodiments will be apparent to those skilled in the art from consideration of the specification and practice of the boundary tracking system disclosed herein. It is intended that the specification and examples be considered as exemplary only, with a true scope of the disclosure being indicated by the following claims and their equivalents.

What is claimed is:

1. A boundary tracking system for a work site, comprising:

a plurality of signal transmitting devices configured to be positioned at underground locations and to originate signals to be transmitted from the underground locations to aboveground having frequencies ranging from about 900 MHz to about 2.4 GHz, wherein the plurality of signal transmitting devices are configured to be activated by a query signal;

a receiving device configured to be located aboveground and to receive the signals having frequencies ranging from about 900 MHz to about 2.4 GHz that originate from the plurality of signal transmitting devices and to generate an output based on the received signals; and a controller configured to determine the underground locations of the plurality of signal transmitting devices based on the output from the receiving device.

2. The boundary tracking system of claim 1, wherein the boundary tracking system includes:

a display unit mounted on a machine; and the controller is further configured to display, on the display unit, the location of the plurality of signal transmitting devices.

3. The boundary tracking system of claim 2, wherein the receiving device is located on an alternate machine.

4. The boundary tracking system of claim 1, wherein the work site is a mine.

5. The boundary tracking system of claim 2, wherein the display unit is configured to display a location of at least one of the plurality of signal transmitting devices relative to at least one of a tool and the machine.

6. The boundary tracking system of claim 2, wherein the controller is configured to:

determine a location of at least one boundary based on underground locations of the plurality of signal transmitting devices, and display the location of the at least one boundary.

7. The boundary tracking system of claim 1, wherein the plurality of signal transmitting devices includes first and second groups, each of the signal transmitting devices of the first group being configured to transmit a first signal, and each of the signal transmitting devices of the second group being configured to transmit a second signal.

8. The boundary tracking system of claim 7, wherein the controller is configured to determine a first boundary location based on the locations of the first group of signal transmitting devices and a second boundary location based on the locations of the second group of signal transmitting devices, and display the first boundary location and the second boundary location on a display unit.

9. The boundary tracking system of claim 1, wherein at least one of the plurality of signal transmitting devices contains a power source.

10. The boundary tracking system of claim 1, wherein the query signal transmits energy that is received by the plurality of signal transmitting devices and used to activate the plurality of signal transmitting devices.

11. The boundary tracking system of claim 1, wherein the query signal is further configured to deactivate the plurality of signal transmitting devices.

12. A method of tracking a boundary, comprising:

providing a query signal to activate a plurality of signal transmitting devices located to represent at least one boundary of a work site, wherein the plurality of signal transmitting devices are positioned at different underground locations and are configured to originate a plurality of signals having frequencies ranging from about 900 MHz to about 2.4 GHz that are transmitted from the different underground locations to aboveground;

determining the underground locations of the plurality of signal transmitting devices based on the plurality of signals originating from the plurality of signal transmitting devices; and controlling at least one function of a machine based on the underground locations of the plurality of signal transmitting devices.

13. The method of claim 12, wherein the work site is a mine, and the plurality of signal transmitting devices are located to represent at least one ore boundary.

14. The method of claim 12, wherein determining the location of the plurality of signal transmitting devices includes determining the location of at least one of the plurality of signal transmitting devices relative to at least one of a tool and the machine, and wherein the method further includes generating a display representative of a location of the at least one of the plurality of signal transmitting devices relative to at least one of the tool and the machine.

15. The method of claim 14, wherein the generated display includes a top view and a side profile view of the area surrounding the at least one of the plurality of signal transmitting devices.

16. The method of claim 12, wherein determining the location of the plurality of signal transmitting devices includes determining a location of the at least one boundary, and wherein the method further includes generating a display of the at least one boundary.

17. The method of claim 16, wherein generating a display includes generating a display of the at least one boundary in three dimensions.

18. The method of claim 12, wherein the query signal transmits energy that is used to activate the plurality of signal transmitting devices.

19. The method of claim 12, further including deactivating the plurality of signal transmitting devices.

20. A machine, comprising:

a frame;

a tool operably connected to the frame;

a receiving device configured to receive a signal having a frequency ranging from about 900 MHz to about 2.4 GHz and transmitted from at least one of a plurality of signal transmitting devices located to represent a boundary and to generate an output based on the received signals, wherein at least one of the plurality of signal transmitting devices is configured to originate signals to be transmitted from an underground location to an aboveground location and having frequencies ranging from about 900 MHz to about 2.4 GHz;

a transmitter configured to transmit a query signal to activate at least one of the plurality of signal transmitting devices;

a controller configured to receive the output from the receiving device to determine a location of the boundary based on the underground location of the at least one of the plurality of signal transmitting devices; and a display unit configured to display a representation of the boundary.

21. The machine of claim 20, wherein the representation of the boundary includes at least one of a top view and a side view of the boundary.

22. The machine of claim 21, wherein the at least one of the top view and the side view display the boundary in at least two dimensions.

23. The machine of claim 20, wherein the display unit is configured to display a first ore body using a first visual indication and a second ore body using a second visual indication.

24. The machine of claim 20, wherein the receiving device is configured to receive a first signal that originates from a first group of the plurality of signal transmitting devices located underground to represent a first boundary and a second signal that is different to the first signal and originates from a second group of the plurality of signal transmitting devices located underground to represent a second boundary, and the display unit is configured to display a representation of the first boundary and a representation of the second boundary.

25. The machine of claim 24, wherein the display unit is further configured to display the representation of the first boundary and the representation of the second boundary in a two dimensional top view and a two dimensional side view.

26. The machine of claim 20, wherein the query signal transmits energy that is received by the plurality of signal transmitting devices and used to activate the plurality of signal transmitting devices.

27. The machine of claim 20, wherein the query signal is further configured to deactivate the plurality of signal transmitting devices.

* * * * *